United States Patent [19]

Plummer, III

[11] Patent Number: 4,572,922

[45] Date of Patent: Feb. 25, 1986

[54] SHIELDED RE-ENTERABLE JACKET WITH DIELECTRIC SPACER AND METHOD OF MAKING SAME

[76] Inventor: Walter A. Plummer, III, 14831 Foxcroft Rd., Tustin, Calif. 92680

[21] Appl. No.: 587,590

[22] Filed: Mar. 8, 1984

[51] Int. Cl.[4] ..... H01B 7/34; H01R 43/00

[52] U.S. Cl. ..... 174/36; 29/825; 174/DIG. 11; 493/356

[58] Field of Search ..... 174/36, DIG. 11; 156/54, 56; 29/828, 825

[56] References Cited

U.S. PATENT DOCUMENTS

| | | | |
|---|---|---|---|
| 2,960,561 | 11/1960 | Plummer | 174/36 |
| 3,032,604 | 5/1962 | Timmons | 174/36 |
| 3,089,915 | 5/1963 | Plummer | 174/36 |
| 3,254,678 | 6/1966 | Plummer | 174/36 |
| 3,286,017 | 11/1966 | Batcher | 174/36 |
| 3,413,406 | 11/1968 | Plummer | 174/36 |
| 3,467,761 | 9/1969 | Plummer | 174/DIG. 11 |
| 3,582,532 | 6/1970 | Plummer | 174/36 |
| 3,612,743 | 10/1971 | Angele | 174/106 R X |
| 3,624,267 | 11/1971 | Plummer | 174/36 |
| 3,757,029 | 9/1973 | Marshall | 174/36 |
| 4,409,427 | 10/1983 | Plummer, III | 174/36 |
| 4,461,076 | 7/1984 | Plummer, III | 29/825 |

FOREIGN PATENT DOCUMENTS

| | | | |
|---|---|---|---|
| 1509648 | 1/1968 | France | 174/DIG. 11 |

*Primary Examiner*—A. T. Grimley
*Assistant Examiner*—Morris H. Nimmo
*Attorney, Agent, or Firm*—Sellers and Brace

[57] ABSTRACT

Disclosed is a method of making a unitary re-enterable shielded jacket assembly for a plurality of insulated conductors provided with a dielectric spacer of non-conductive netting arranged and effective to provide a layer of air cells between the jacket shielding and the embraced conductors thereby to stabilize the impedance of the cable assembly from end to end thereof. One lateral edge of the dielectric spacer is attached to the jacket adjacent the inner shielding layer thereof and is sufficiently wide for its opposite edges to overlap when the jacket seam is closed. The dielectric spacer may be pleated lengthwise thereof to provide pockets for separate ribbon cables, the pleats being interconnected by hinges formed by groups of severed transverse strands which groups are separated by at least one unsevered transverse strand.

19 Claims, 5 Drawing Figures

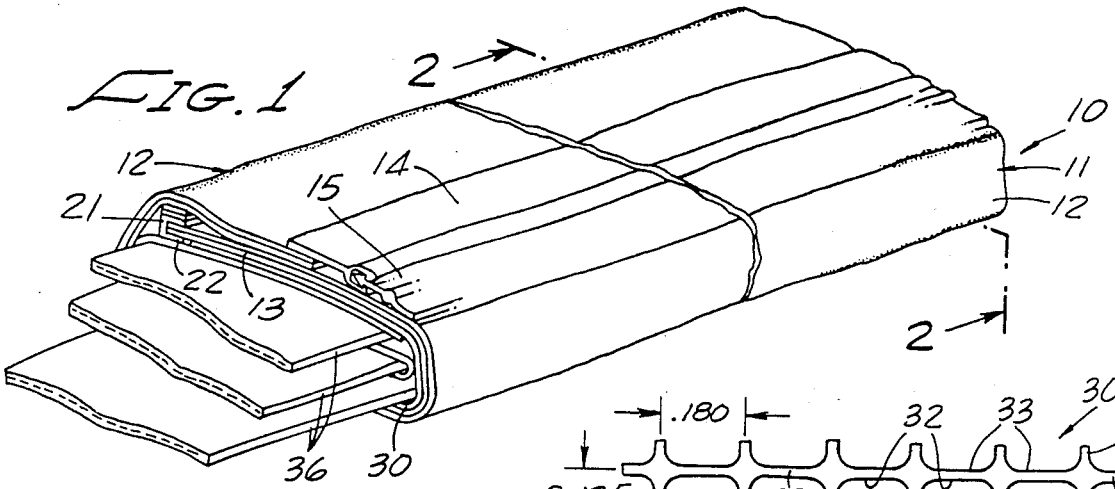
FIG. 1
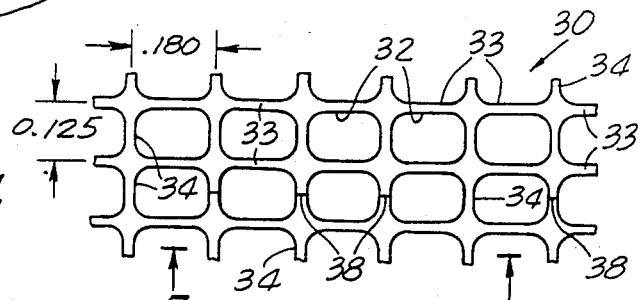
FIG. 4
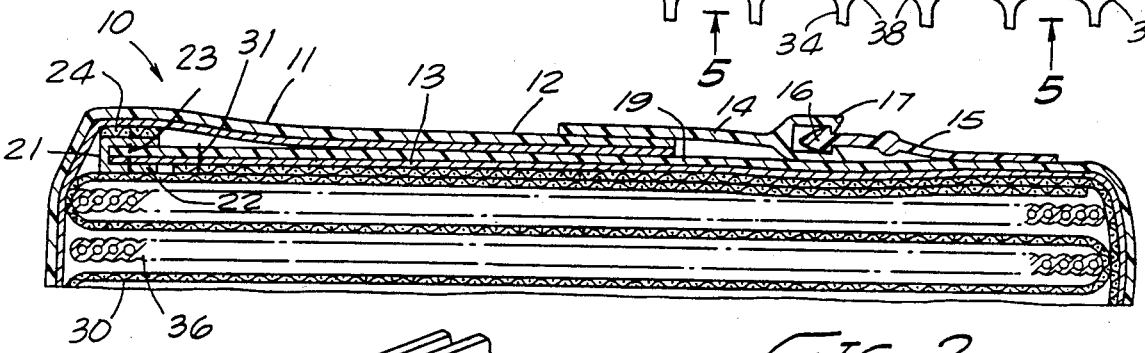
FIG. 2
FIG. 5
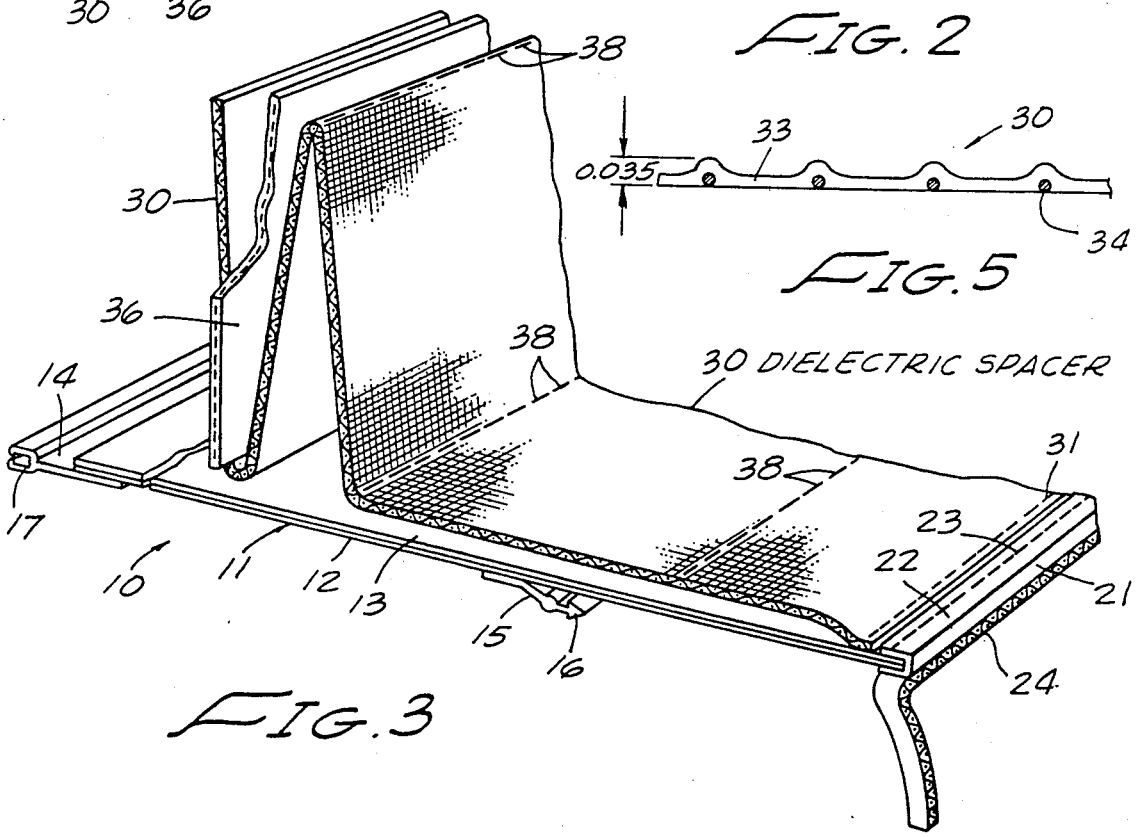
FIG. 3

SHIELDED RE-ENTERABLE JACKET WITH DIELECTRIC SPACER AND METHOD OF MAKING SAME

This invention relates to shielded jacketing for cabling, and more particularly to a novel re-enterable shielded jacket equipped with a dielectric spacer fixed to the jacket and arranged between the jacket shielding and the insulated conductors which spacer may be pleated to provide pockets for separate ribbon cables to maintain them dielectrically separated from one another and from the jacket shielding.

BACKGROUND OF THE INVENTION

It is known that low amplitude signals handled by multiple conductors within shielded jacketing pose problems arising from variable impedance of the cable assembly as well as from cross talk between conductors which can be eliminated or practically inhibited by appropriate provision for lateral spacing between the cable shield and the conductors and by properly spacing the conductors from one another. Certain proposals have been made to accomplish these objectives but these are subject to various shortcomings and objections owing to the multiplicity of components to be assembled and the difficulty and labor time required to accomplish the assembly. For example, it has been proposed to employ a separate non-conductive dielectric spacer element between each adjacent pair of ribbon cables but it is difficult and time consuming to assemble these components and to maintain them in their desired relative positions while enclosing them within a shielded outer enclosure.

SUMMARY OF THE INVENTION

The foregoing and other shortcomings of prior proposals for reducing crosstalk and for inhibiting variations in the rated impedance of the cable assembly lengthwise thereof by providing a simply constructed unitary re-enterable jacket assembly equally suitable and effective for use with a bundle of conductors or with one or more superimposed ribbon cables. When so employed, the dielectric spacer is folded into accordion pleats forming pockets each chargeable with a separate ribbon cable, the arrangement being such that when the jacketing is closed each ribbon cable is separated from another by the spacer and each lateral edge of the ribbon cables is likewise separated from the shielding layer of the jacket by a layer of the spacer. The spacer provides a dielectric layer of minimum thickness between all conductors and the shielding thereby inhibiting crosstalk between adjacent cables and providing a cable assembly of constant rated impedance. Folding of the dielectric spacer along desired hinge axes is facilitated by slitting groups of transverse strands of the spacer to either aligned side of unsevered transverse strands. Typically, the hinge axes are spaced apart by the transverse width of the ribbon cables to be maintained spaced from one another. In all cases the width of the spacer is sufficient for the opposite lateral edges to overlap one another when the jacketing is assembled by closing a separable seam extending lengthwise thereof. All components are secured together in a unitary assembly including a jacket guard flap having a width at least bridging the separable claim components and preferably approximating as much as one fourth the girth of the jacketing. The edge of the guard flap is provided with an overturned strip of conductive material embracing its edge to the outer leg of which a flexible grounding lead is secured.

In view of the foregoing, it is a primary object of this invention to provide a unique unitary re-enterable shielded cabling jacket and method of making the same having attached thereto a dielectric spacer arranged to maintain all conductors spaced a predetermined minimum distance from the jacket shielding and cooperating therewith to maintain the cable rated impedance constant.

Another object of the invention is the provision of an improved method and unitary article of manufacture for enclosing a plurality of conductors in a shielded re-enterable enclosure and dielectrically isolated from the shielding by a spacer providing an air layer of predetermined thickness.

Another object of the invention is the provision of a dielectric spacer formed by spaced apart strands crisscrossing one another at right angles and foldable into accordion pleated configuration by hinges formed by groups of slit transverse strands separated from one another by one or more unsevered transverse strands.

Another object of the invention is the provision of a re-enterable cable shielding jacket of one piece unitary construction provided with a dielectric spacer anchored along one lateral edge thereof to the interior of the jacket and sufficiently wide transversely of the jacket to have its lateral edges overlap when the jacketing is assembled to cabling.

These and other more specific objects will appear upon reading the following specification and claims and upon considering in connection therewith the attached drawing to which they relate.

Referring now to the drawing in which a preferred embodiment of the invention is illustrated:

FIG. 1 is a fragmentary perspective view of an illustrative embodiment of the invention jacketing assembled about a plurality of superimposed ribbon cables;

FIG. 2 is a partial cross sectional view on an enlarged scale taken along line 2—2 on FIG. 1;

FIG. 3 is a perspective view showing the jacketing open with the dielectric spacer partially folded into an accordion pleated configuration and showing one ribbon cable in place;

FIG. 4 is a fragmentary plan view on a magnified scale showing a portion of the dielectric spacer and also showing a portion of the hinge interconnecting adjacent panels of the pleating; and FIG. 5 is a cross sectional view taken long line 5—5 on FIG. 4.

An illustrative embodiment of the invention jacketing is shown in FIGS. 1–5 and is designated generally 10. This unitary assembly includes a re-enterable seamed jacket 11 having an outer layer of impervious non-conductive elastomeric material 12 and an inner layer 13 of conductive foil. As herein shown, the outer and inner layers 12, 13 are laminated to one another but the inner layer of conductive material may comprise one or more layers of fine mesh secured at one or more points to the outer layer but otherwise unattached thereto.

Jacketing 11 includes separable interlocking seam members 14, 15, the adjacent lateral edges of which interlock with one another, such as barbed male member 16 adapted to interlock with the inwardly projecting barbs of the U-shaped female portion 17 extending along the edge of seam member 14. As herein shown, seam member 14 is fused or otherwise secured to the left hand lateral edge of jacket 11 whereas seam member 15 is secured to the exterior of the other lateral edge of jacketing 11 along an area parallel to but spaced substantially to the right of the other lateral edge of the jacket. The distance between the right hand lateral edge of the jacketing and the point of attachment thereto of seam member 15 provides a guard flap 19 sufficiently wide to underlie and bridge the seam members when closed and preferably sufficiently wide to span approximately one fourth the girth of the assembled jacketing.

Embracing the free edge of guard flap 19 is a U-shaped strip of conductive foil 21 having its inner leg 22 in intimate contact with the foil layer 13. Its outer leg is secured against the outer surface of the jacket elastomeric layer 11 by stitching or the like 23 which also serves to secure grounding lead 24 to the guard flap and in intimate conductive relation to the outer leg of foil strip 21.

Secured to the interior of jacketing 11 is a flexible dielectric spacer 30 formed in one unitary netlike structure of suitable insulation such as polyethylene reinforced vinyl or Dacron. Spacer 30 is at least sufficiently wide to encircle the interior of the jacketing with its opposite lateral edges overlapping and one of which edges is here shown as secured to the right hand edge of guard flap 19 by stitching 31. If the spacer is being used to separate plural ribbon cables from one another, it has a width very substantially in excess of the width of the open jacketing.

As herein shown the spacer is molded in one piece to form a multiplicity of air cells 32 opening through both surfaces of the spacer. These cells, as herein shown, are generally of rectangular configuration and formed by longitudinal strands 33 and transverse strands 34 lying at right angles thereto and integrally joined to one another at points of crossover. Excellent results for its intended purposes have been obtained when the distance between transverse strands is approximately 0.180 inches and the distance between longitudinal strands is 0.125 inches and the thickness of the spacer is 0.035 inches as determined by the high points on its opposite faces. The cross sectional diameters of both longitudinal and transverse strands are very substantially smaller than the spacer thickness determined by the 0.035 measurement. In consequence, it will be apparent that a very substantial blanket of air is assured between the opposite faces of the spacer, this blanket being 0.035 inches or about 35 mils thick.

An important feature of the dielectric spacer when used to embrace ribbon cables 36 is the provision of a hinge adjacent alternate edges of ribbon cables. A simply constructed and very satisfactory hinge is formed by slitting transverse strands 34 midway between a pair of adjacent longitudinal strands 33. Such slits are indicated at 38 in FIG. 4, there being a group of three adjacent slits separated from a similar adjacent group of slits by an unsevered transverse strand 34. A lesser or greater number of unsevered strands may be employed but a single non-severed strand between adjacent groups of three severed strands has been found to provide a hinge between pleats of adequate strength coupled with ease of foldability.

The mode of assembly and use of the invention shielded jacket will be readily apparent from the foregoing detailed description. If the width of the dielectric spacer 30 is to be used with a plurality of conductors its width is sufficiently greater than the width of the main body of the jacket as to provide an ample overlap when the conductors are enclosed by the jacketing, it being noted that all will then be spaced from the shielding layer 13 at least by the thickness of the spacer. If the jacketing is to be used to enclose plural ribbon cables 36 then a much wider spacer is employed, the width being adequate to provide the requisite number of pockets for separate ribbon cables. Also when pleated, the spacer is preferably provided with a hinge interconnecting all pleats and formed by spaced apart groups of slits 38 to either side of an unsevered transverse strand as described above. The spacer is then folded as indicated in FIG. 3 and individual ribbon cables are enclosed in each of the pockets between pleats to provide a flat flexible cable assembly which is re-enterable at any time to provide a compact assembly wherein crosstalk between ribbons is eliminated and the rated capacity of the cable remains constant.

While the particular shielded re-enterable jacket with dielectric spacer and method of making same herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A unitary shielded jacket for separable assembly about a plurality of insulated conductors to shield them from external flux fields and to maintain the rated impedance of the jacketed conductors generally constant from end-to-end thereof, said jacket comprising:

a main body of flexible material having an outer layer of non-conductive material coextensive with and laminated to an inner layer of conductive material;

a pair of separable interlocking seam members secured to the opposite lateral edge portions of said main body with one of said seam members being spaced substantially inwardly of and parallel to the adjacent lateral edge thereby to form a guard flap wide enough to underlie and bridge said seam members when interlocked;

a U-shaped strip of conductive material embracing and secured to the outer longitudinal edge of said guard flap;

a conductive grounding lead secured to the outer leg of said U-shaped strip; and a dielectric spacer of non-conductive flexible netting material having one edge secured to the inner side of said guard flap and extending the full length of said jacket and sufficiently wide to provide overlapping encirclement of the interior of said jacket when snugly assembled about a group of insulated conductors; said dielectric spacer being constructed and arranged to provide a multiplicity of air cells adjacent said inner layer of conductive material which air cells have a thickness of about 35 mils or more.

2. A unitary shielded jacket as defined in claim 1 characterized in that said dielectric spacer is formed of parallel strands extending longitudinally of said jacket and parallel transverse strands integral with said longitudinal strands at points of crossover; said spacer being foldable into a plurality of pleats each sized to accommodate a ribbon cable extending lengthwise of said spacer; said pleats being interconnected by hinges having aligned axes lying between an adjacent pair of said longitudinal strands and extending crosswise of groups of severed transverse strands which groups are separated by at least one unsevered strand.

3. A unitary shielded jacket as defined in claim 2 characterized in that said guard flap has a width of the order of approximately one fourth of the width of said main body.

4. That method of providing a jacket for snugly enclosing a multiplicity of insulated conductors in an electromagnetically shielded jacketing assembly in a manner to maintain the rated impedance of said insulated conductors enclosed thereby substantially constant from end-to-end of said conductors which comprises:

providing a continuous strip of flexible shielded jacketing having an outer layer of flexible elastomeric material and a coextensive inner layer of conductive shielding material in contact with one another;

securing flexible separable interlocking seam means to the opposite lateral edge portions of said strip including a first member secured lengthwise of one outer lateral edge of said jacketing strip and a second member separably interlockable with said first member and secured lengthwise of the other outer lateral edge thereof along an area spaced inwardly of said other lateral edge thereby to provide a guard flap sufficiently wide to underlie and bridge said first and second seam members when interlocked with one another;

providing said shielded jacketing assembly with dielectric spacer means of non-conductive flexible mesh material sufficiently wide for encircling said insulated conductors and to provide a multiplicity of air cells between said layer of shielding material and said insulated conductors when wrapped thereabout; and providing said conductive shielding material with conductive grounding lead means.

5. That method defined in claim 4 characterized in the step of providing said jacketing assembly with said guard flap in a width adequate to bridge said first and second seam members when interlocked with one another.

6. That method defined in claim 3 characterized in the step of employing said guard flap having a width of the order of one fourth the girth of said jacket assembly when said seam means is closed.

7. That method defined in claim 5 characterized in the step of utilizing said dielectric spacer means molded in one piece from flexible plastic material.

8. That method defined in claim 4 characterized in the steps of folding said dielectric spacer means into one or more pleats with the folds thereof extending lengthwise of said jacketing assembly and forming at least one pocket adapted to receive and embrace a separate ribbon cable; and arranging said dielectric spacer means to completely encircle each ribbon cable and to separate each lateral edge thereof from the juxtaposed portion of said inner layer of conductive shielding material.

9. That method defined in claim 8 characterized in the step of providing said dielectric spacer means with at least one hinge extending longitudinally of said spacer means and interconnecting contiguous panels of said pleats.

10. That method defined in claim 9 characterized in the step of forming said hinge by severing successive groups of strands of said dielectric mesh material extending transversely of said spacer means which groups of severed strands are separated by at least one unsevered transverse strand, thereby to form a hinge consisting of said unsevered strands.

11. That method defined in claim 4 characterized in the step of securing said dielectric spacer to said shielded assembly along the lateral edge of said guard flap.

12. That method defined in claim 11 characterized in the step of leaving the major portion of said dielectric spacer unattached to but lying loosely against said inner layer of conductive shielding material when said jacketing assembly is assembled about insulated conductors.

13. That method defined in claim 11 characterized in the steps of embracing and securing to the longitudinal edge of said guard flap a U-shaped strip of conductive material with one leg of said strip in conductive contact with the inner layer of said shielding material.

14. That method defined in claim 13 characterized in the step of employing separate means for securing said dielectric spacer and said U-shaped strip of conductive material to said guard flap.

15. That method defined in claim 4 characterized in the step of utilizing said dielectric spacer means provided with a multiplicity of air cells opening through both surfaces of said dielectric spacer means.

16. That method defined in claim 15 characterized in the step of utilizing said dielectric spacer means in which said open ended air cells have a thickness of the order of 35 mils or more.

17. That method of providing a jacket for snugly enclosing a multiplicity of insulated conductors in an electromagnetically shielded jacketing assembly in a manner to maintain the rated impedance of said insulated conductors enclosed thereby substantially constant from end-to-end of said conductors which comprises:

providing a continuous strip of flexible shielded jacketing having an outer layer of flexible elastomeric material and a coextensive inner layer of conductive shielding material in contact with one another;

securing flexible separable interlocking seam means to the opposite lateral edge portions of said strip of flexible elastomeric material including a first member secured lengthwise of one outer lateral edge thereof and a second member separably interlockable with said first member and secured lengthwise of the other outer lateral edge thereof along an area spaced inwardly of said other lateral edge thereby to provide a guard flap sufficiently wide to underlie and bridge said first and second seam members when interlocked with one another; and providing said shielded jacketing assembly with dielectric spacer means of non-conductive mesh material having a multiplicity of air cells extending therethrough and which said dielectric spacer means is sufficiently wide and sufficiently long for positioning between the length and width of conductors adapted to be enclosed by said jacketing assembly and between said conductors and said layer of conductive shielding material.

18. That method defined in claim 17 characterized in the steps of utilizing said dielectric spacer means formed in one piece, and attaching one edge of said spacer means to said one lateral edge of said continuous strip of flexible shielded jacketing.

19. That method defined in claim 17 characterized in the steps of providing said dielectric spacer means with hinges having axes lying parallel to one another longitudinally of said jacketing assembly to facilitate folding said dielectric spacer means into panels thereby to form pockets adapted to house and separate one or more conductors from one another.

* * * * *